US007378207B2

(12) United States Patent
Oyama et al.

(10) Patent No.: US 7,378,207 B2
(45) Date of Patent: May 27, 2008

(54) MAGENTA TONER AND PRODUCTION PROCESS THEREOF

(75) Inventors: Fuminari Oyama, Tokyo (JP); Kazu Niwa, Tokyo (JP)

(73) Assignee: Zeon Corporation, Tokyo (JP)

( * ) Notice: Subject to any disclaimer, the term of this patent is extended or adjusted under 35 U.S.C. 154(b) by 355 days.

(21) Appl. No.: 10/526,473

(22) PCT Filed: Sep. 5, 2003

(86) PCT No.: PCT/JP03/11361

§ 371 (c)(1),
(2), (4) Date: Mar. 3, 2005

(87) PCT Pub. No.: WO2004/036317

PCT Pub. Date: Apr. 29, 2004

(65) Prior Publication Data

US 2005/0250033 A1 Nov. 10, 2005

(30) Foreign Application Priority Data

Sep. 6, 2002 (JP) ..... 2002-260850

(51) Int. Cl.
*G03G 9/097* (2006.01)

(52) U.S. Cl. ..... 430/108.23; 430/110.2; 430/137.15

(58) Field of Classification Search ..... 430/108.23, 430/110.2, 137.15
See application file for complete search history.

(56) References Cited

U.S. PATENT DOCUMENTS

| | | | | |
|---|---|---|---|---|
| 6,667,140 | B2 * | 12/2003 | Tosaka et al. | 430/108.23 |
| 2003/0195274 | A1 * | 10/2003 | Nakamura et al. | 523/160 |
| 2004/0009294 | A1 * | 1/2004 | Kuribayashi et al. | 427/212 |
| 2004/0013961 | A1 | 1/2004 | Niwa et al. | 430/107.1 |

FOREIGN PATENT DOCUMENTS

| | | |
|---|---|---|
| EP | 0741337 A1 | 11/1996 |
| JP | 63-060458 | 3/1988 |
| JP | 01-217464 | 8/1989 |
| JP | 03-015858 | 1/1991 |
| JP | 03-175456 | 7/1991 |
| JP | 03-243954 | 10/1991 |
| JP | 09-022149 | 1/1997 |
| JP | 9-22149 | 1/1997 |
| JP | 10-312088 | 11/1998 |
| JP | 11-015192 | 1/1999 |
| JP | 2000-081734 | 3/2000 |
| JP | 2000-181144 | 6/2000 |
| JP | 2001-209207 | 8/2001 |
| JP | 2002-072569 | 3/2002 |
| JP | 2002-72569 | 3/2002 |
| JP | 2002-091086 | 3/2002 |
| JP | 2002-108011 | 4/2002 |
| JP | 2002-108012 | 4/2002 |
| JP | 2002-156795 | 5/2002 |
| JP | 2002-182433 | 6/2002 |
| JP | 2002-189317 | 7/2002 |
| JP | 2002-215848 | 7/2003 |
| JP | 2003-215848 | 7/2003 |
| JP | 2002-223018 | 8/2003 |
| JP | 2003-223018 | 8/2003 |

OTHER PUBLICATIONS

International Search Report dated Feb. 3, 2004.

* cited by examiner

*Primary Examiner*—John L Goodrow
(74) *Attorney, Agent, or Firm*—Westerman, Hattori, Daniels & Adrian, LLP.

(57) ABSTRACT

The invention relates to a magenta toner having magenta-colored resin particles comprising at least a binder resin and a magenta colorant. The magenta pigment is a magenta pigment composed of a combination of C.I. Pigment Red 31 and C.I. Pigment Red 150.

19 Claims, No Drawings

MAGENTA TONER AND PRODUCTION PROCESS THEREOF

TECHNICAL FIELD

The present invention relates to a magenta toner for developing an electrostatic latent image formed on a photosensitive member by an electrophotographic process or electrostatic recording process, and more particularly to a magenta toner which can be used in formation of full-color images, and a production process thereof.

In the present invention, magenta-colored resin particles comprising at least a binder resin and a magenta colorant may be referred to as "magenta toner particles" in some cases. Magenta-colored resin particles obtained by a polymerization process may also be referred to as "magenta-colored polymer particles" in some cases. In the present invention, developers containing the magenta-colored resin particles such as a one-component developer comprising the magenta-colored resin particles and an external additive (for example, a flowability improver) and a two-component developer comprising the magenta-colored resin particles and carrier particles are called "magenta toners".

BACKGROUND ART

In an image forming apparatus such as an electrophotographic apparatus or electrostatic recording apparatus, an electrostatic latent image formed on a photosensitive member is first developed with a developer (toner). After the toner image formed on the photosensitive member is then transferred to a transfer medium such as paper as needed, the image is fixed thereto by any of various methods such as heating, pressing and use of solvent vapor.

As such image forming apparatus, a digital full-color copying machine and a digital full-color printer are put to practical use. In the digital full-color copying machine, after a colored image original is subjected to color separation through respective filters of blue, green and red, electrostatic latent images of the respective colors composed of a dot diameter of 20 to 70 μm corresponding to the colored image original are formed. These electrostatic latent images are developed with respective toners of yellow, magenta, cyan and black colors to form a full-color image making good use of a subtractive mixture effect.

In recent years, a demand for formation of full-color images with high image quality and high definition has more and more increased. In order to improve color reproducibility in particular, it is desirable that an image using color toners can be printed with a hue equivalent to printing with inks. As colorants for magenta toner, have heretofore been generally used organic pigments such as quinacridone pigments, perillene pigments, thioindigo pigments and β-oxynaphthenic anilide pigments (i.e., Naphthol AS pigments). Among these, the quinacridone pigments are widely used in that they are excellent in light resistance, heat resistance and transparency. With respect to the quinacridone pigments, it has been proposed to use a quinacridone pigment and another quinacridone pigment in combination or use a quinacridone pigment and another magenta pigment in combination for the purpose of improving toner properties.

For example, Japanese Patent Application Laid-Open No. 10-312088 has proposed a magenta toner making combined use of C.I. Pigment Red 122 and C.I. Pigment Red 57:1 as a colorant. Japanese Patent Application Laid-Open No. 2000-181144 has proposed a magenta toner making combined use of a dimethylquinacridone pigment (i.e., C.I. Pigment Red 122) and at least one red pigment having negatively charging ability or weakly positively charging ability as a colorant. Japanese Patent Application Laid-Open No. 2002-91086 has proposed a magenta toner making combined use of a quinacridone pigment and a Naphthol AS pigment or β-naphthol lake pigment as a colorant.

However, these magenta toners has involved a problem that magenta toner particles are easy to be broken by contact between the magenta toner particles or stress between a feed roll and a development roll, or between a development and a photosensitive member in an image forming apparatus. When the magenta toner particles are broken, the flowability and printing density of the magenta toner are lowered.

In addition, C.I. Pigment Red 57:1 that is a magenta pigment used in respective Examples in Japanese Patent Application Laid-Open No. 10-312088 and Japanese Patent Application Laid-Open No. 2002-91086 is poor in light resistance, and so the resulting image may be faded with time in some cases.

Further, since C.I. Pigment Red 5 and C.I. Pigment Red 209 that are magenta pigments used in respective Examples in Japanese Patent Application Laid-Open Nos. 2000-181144 and 2002-91086 are chlorine atom-containing compounds, there is a possibility that dioxin may be generated when paper, on which images have been formed, is incinerated.

Japanese Patent Application Laid-Open No. 2000-156795 discloses magenta toners containing C.I. Pigment Red 122, C.I. Pigment Violet 19 and C.I. Pigment Red 150 as colorants. However, these magenta toners are low in printing density and may cause fog in some cases.

As described above, when a quinacridone pigment is used as a magenta colorant, light resistance is improved compared with the case where another pigment is used. However, such a pigment tends to lower the printing density of the resulting magenta toner. In order to raise the printing density using the quinacridone pigment, it is necessary to use the pigment in a great amount. When the quinacridone pigment is used in a great amount, however, not only the cost of the resulting magenta toner is increased, but also the fixing ability of the toner is liable to lower.

On the other hand, it is investigated to use a Naphthol AS pigment alone without using any quinacridone pigment to provide a magenta toner. Naphthol AS pigments are classified into a mono-azo system and a dis-azo system. However, mono-azo pigments are generally widely adopted.

Japanese Patent Application Laid-Open Nos. 2000-81734 and 2002-182433 disclose magenta toner particles comprising C.I. Pigment Red 31 as a mono-azo pigment in Examples thereof. These magenta toner particles are applied to formation of images by a two-component development system as a two-component developer combined with carrier particles. However, the investigation by the present inventors has revealed that when these magenta toner particles are applied to formation of images by a non-magnetic one-component development system, not only the density of an image printed becomes low, but also hot offset occurs, and moreover storage stability becomes poor.

Japanese Patent Application Laid-Open No. 2002-72569 discloses a magenta toner comprising C.I. Pigment Red 150 as a mono-azo pigment. However, the investigation by the present inventors has revealed that not only this magenta toner can form only images having a hue far from a hue by printing with inks and is poor in color reproducibility, but also it is low in printing density and poor in low-temperature fixing ability and causes fog under high-temperature and high-humidity conditions.

DISCLOSURE OF THE INVENTION

It is an object of the present invention to provide a magenta toner which is high in printing density, causes no fog and can reproduce a hue equivalent to printing with inks.

Another object of the present invention is to provide a magenta toner has low-temperature fixing ability and causes no fog even under severe environments of low temperature and low humidity, and high temperature and high humidity.

A further object of the present invention is to provide a magenta toner which prevents magenta-colored resin particles from breaking in an image forming apparatus to low flowability, prevents an image obtained by printing from fading and has little possibility of causing an environmental problem even when a transfer medium, on which an image has been formed with the toner, is incinerated.

A still further object of the present invention is to provide a production process of a magenta toner having such excellent properties as described above.

The present inventors have carried out an extensive investigation with a view toward achieving the above-described objects. As a result, it has been found that the above-described objects can be achieved by using specific magenta pigments in combination as a magenta colorant in a magenta toner having magenta-colored resin particles comprising at least a binder resin and the magenta colorant. The present invention has been led to completion on the basis of this finding.

According to the present invention, there is thus provided a magenta toner having magenta-colored resin particles comprising at least a binder resin and a magenta colorant, wherein the magenta colorant is a magenta pigment composed of a combination of C.I. Pigment Red 31 and C.I. Pigment Red 150.

According to the present invention, there is also provided a process for producing a magenta toner having magenta-colored resin particles, which comprises Step 1 of preparing a polymerizable monomer composition containing at least a polymerizable monomer and a magenta colorant and Step 2 of polymerizing the polymerizable monomer composition in an aqueous dispersion medium to form the magenta-colored resin particles, wherein a magenta pigment composed of a combination of C.I. Pigment Red 31 and C.I. Pigment Red 150 is used as the magenta colorant.

BEST MODE FOR CARRYING OUT THE INVENTION

1. Magenta-Colored Resin Particles

The magenta-colored resin particles (magenta toner particles) are colored resin particles comprising a binder resin and a magenta pigment as essential components. As examples of the binder resin, may be mentioned various resins heretofore used as binder resins in a technological field of toners, such as polystyrene, styrene-n-butyl acrylate copolymers, polyester resins and epoxy resins.

(1) Magenta Colorant:

The magenta colorant used in the present invention is a magenta pigment composed of a combination of C.I. Pigment Red 31 and C.I. Pigment Red 150. The combination of these two pigments also includes the form of a mixed crystal in addition to the form of a mixture. The use of the magenta pigment composed of the combination of these two pigments can provide a magenta toner capable of forming images having a hue equivalent to magenta in printing with inks. Since the magenta pigment contains no chlorine atom, there is little possibility that an environmental problem by generating dioxin may be caused even when a transfer medium such as paper, on which an image has been formed with the resulting magenta toner, is incinerated.

The surface of the magenta pigment used in the present invention may be treated with a rosin compound or the like for the purpose of improving the dispersibility of the pigment in the resulting magenta-colored resin particles. As a method for the surface treatment, may be adopted any publicly known method such as mixing of the magenta pigment with a treating agent. However, if the amount of the treating agent to the magenta pigment is too great, the resulting magenta toner may cause fog under high-temperature and high-humidity conditions in some cases. Accordingly, the amount of the treating agent used is preferably at most 20 parts by mass, more preferably at most 10 parts by mass, particularly preferably at most 5 parts by mass per 100 parts by mass of the magenta pigment.

A proportion of C.I. Pigment Red 31 to C.I. Pigment Red 150 used is within the range of preferably from 30:70 to 80:20, more preferably from 40:60 to 70:30, particularly preferably from 50:50 to 60:40 in terms of a mass ratio.

The magenta pigment composed of these two pigments is generally used within the range of 1 to 10 parts by mass in total per 100 parts by mass of the binder resin.

(2) Charge Control Agent:

In the present invention, a charge control agent is preferably contained in the magenta-colored resin particles for the purpose of controlling the charge level of the resulting magenta toner. Among charge control agents, charge control resins are particularly preferred because they are high in compatibility with the binder resin and colorless and can provide a magenta toner stable in charging ability in the case of continuous high-speed color-printing.

As the charge control resins, are preferred quaternary ammonium (salt) group-containing copolymers prepared in accordance with a process described in, for example, Japanese Patent Application Laid-Open Nos. 63-60458, 3-175456, 3-243954 and 11-15192 and sulfonic (salt) group-containing copolymers prepared in accordance with a process described in, for example, Japanese Patent Application Laid-Open Nos. 1-217464 and 3-15858.

A monomer unit having a quaternary ammonium (salt) group or sulfonic (salt) group contained in these copolymers is contained in a proportion of 0.5 to 15% by mass, preferably 1 to 10% by mass in each copolymer. When the content of these monomer units falls within the above-described range, the charge level of the resulting magenta toner is easy to be controlled, and the occurrence of fag can be lessened.

The weight average molecular weight of the charge control resin is within the range of generally 2,000 to 50,000, preferably 4,000 to 40,000, more preferably 6,000 to 30,000. When the weight average molecular weight of the charge control resin used falls within this range, the saturation and transparency of the resulting magenta toner can be highly retained.

The glass transition temperature of the charge control resin is within the range of generally 40 to 80° C., preferably 45 to 75° C., more preferably 45 to 70° C. When the glass transition temperature of the charge control resin used falls within this range, a balance between storage stability and fixing ability in the resulting magenta toner can be improved.

The proportion of the charge control resin used is within the range of generally 0.01 to 20 parts by mass, preferably 0.1 to 10 parts by mass per 100 parts by mass of the binder resin.

(3) Parting Agent:

In the present invention, a parting agent is preferably contained in the magenta-colored resin particles. Examples of the parting agent include polyolefin waxes such as low molecular weight polyethylene, low molecular weight polypropylene and low molecular weight polybutylene; natural plant waxes such as candelilla, carnauba, rice, Japan wax and jojoba; petroleum waxes such as paraffin, microcrystalline and petrolatum, and modified waxes thereof; synthetic waxes such as Fischer-Tropsch wax; and polyfunctional ester compounds such as pentaerythritol tetramyristate, pentaerythritol tetrapalmitate and dipentaerythritol hexamyristate. These parting agents may be used either singly or in any combination thereof.

Among these parting agents, synthetic waxes, terminal-modified polyolefin waxes, petroleum waxes and polyfunctional ester compounds are preferred. Among the polyfunctional ester compounds, pentaerythritol esters whose endothermic peak temperatures upon heating fall within the range of 30 to 200° C., preferably 40 to 160° C., more preferably 50 to 120° C. in a DSC curve as determined by a differential scanning calorimeter (DSC), and dipentaerythritol esters whose endothermic peak temperatures fall within the range of 50 to 80° C. are preferred from the viewpoint of improving a balance between the fixing ability and the parting property in the resulting magenta toner. Among the polyfunctional ester compounds such as pentaerythritol esters whose endothermic peak temperatures upon heating fall within the range of 30 to 200° C., and dipentaerythritol esters whose endothermic peak temperatures fall within the range of 50 to 80° C., those having a molecular weight of at least 1,000, a solubility of 5 parts by mass in 100 parts by mass of styrene at 25° C. and an acid value of at most 10 mgKOH/g are particularly preferred because they exhibits a marked effect on lowering of the fixing temperature of the resulting magenta toner. The endothermic peak temperature is a value measured in accordance with ASTM D 3418-82. Since the low-temperature fixing ability of the resulting magenta toner is improved by using these parting agents, and a fixing region becomes broad (namely, offset margin becomes great), this magenta toner can be applied to not only an image forming apparatus heretofore used, on a fixing roll of which an anti-offset liquid has been coated, but also an image forming apparatus that is not coated with such an anti-offset liquid.

The proportion of the parting agent used is within the range of generally 0.5 to 50 parts by mass, preferably 1 to 20 parts by mass per 100 parts by mass of the binder resin.

(4) Magenta-Colored Resin Particles with Core-Shell Structure:

The magenta-colored resin particles can be provided as magenta-colored resin particles having a core-shell structure obtained by respectively using two different resin components for interiors (core particles) and exteriors (shell layers) of particles in combination. A magenta toner comprising such magenta-colored resin particles having the core-shell structure may be called a capsule type magenta toner in some cases. In the particles of the core-shell structure, the interiors (core particles) are formed by a resin component having a low softening point or low glass transition temperature, and then coated with a resin component having a softening point or glass transition temperature higher than the first-mentioned resin component, whereby a balance between lowering of fixing temperature and prevention of aggregation (prevention of blocking) during storage can be improved.

In the magenta-colored resin particles of the core-shell structure, the core particles are generally formed by a binder resin, a magenta pigment, a charge control agent, a parting agent and the like, and the shell layer are formed by a resin (polymer) alone.

In the magenta-colored resin particles of the core-shell structure, the volume average particle diameter (dv) of the core particles is within the range of preferably 3.0 to 12.0 μm, more preferably 4.0 to 10.0 μm, particularly preferably 5.0 to 8.0 μm. The particle diameter distribution dv/dp represented by a ratio of the volume average particle diameter dv to the number average particle diameter dp of the core particles is within the range of preferably 1.0 to 1.3, more preferably 1.0 to 1.2.

No particular limitation is imposed on a mass ratio of the core particles to the shell layers in the magenta-colored resin particles of the core-shell structure. However, it is generally within the range of 80/20 to 99.9/0.1. When the proportion of the shell layers is controlled within the above-described range, the resulting magenta toner can have good storage stability and low-temperature fixing ability in combination.

The average thickness of the shell layers in the magenta-colored resin particles of the core-shell structure is within the range of preferably 0.001 to 1.0 μm, more preferably 0.003 to 0.5 μm, particularly preferably 0.005 to 0.2 μm. If the thickness of the shell layers is too great, the fixing ability of the magenta toner may possibly be deteriorated. If the thickness is too small to the contrary, the storage stability of the toner may possibly be deteriorated. In the magenta-colored resin particles of the core-shell structure, all the surfaces of the core particles are not necessarily closely coated with a shell layer, but a part of the surfaces of the core particles may be coated with the shell layer so far as aggregation upon storage can be prevented.

The average particle diameter of the core particles and the average thickness of the shell layers in the magenta-colored resin particles of the core-shell structure can be determined by directly measuring the size and shell thickness of each of plural particles selected at random from an electron photomicrograph thereof to calculate out respective average values when they can be observed through an electron microscope. If the core particle and the shell layer are difficult to clearly distinguish by observation through the electron microscope, an average particle diameter of core particles obtained upon the production of the toner is measured. The average thickness of the shell layers can be calculated out on the basis of the measured value of the average particle diameter of the core particles and the amount of the shell-forming material used in the formation of the shell layers, such as a polymerizable monomer.

(5) Properties of Magenta-Colored Resin Particles:

The volume average particle diameter dv of the magenta-colored resin particles is within the range of preferably 3.0 to 12.0 μm, more preferably 4.0 to 10.0 μm, particularly preferably 5.0 to 8.0 μm. The volume average particle diameter of the magenta-colored resin particles of the core-shell structure is also desirably within the same range as described above. If the volume average particle diameter of the magenta-colored resin particles is too small, the flowability of the resulting magenta toner is lowered, and so its transferability may be lowered, blur may occur, or the printing density may be lowered. If this volume average particle diameter is too great, fog and flying-off of the resulting toner occur, and the resolution of an image formed with such a toner is deteriorated.

No particular limitation is imposed on a particle diameter distribution dv/dp that is a ratio of the volume average particle diameter dv to the number average particle diameter dp in the magenta-colored resin particles. However, it is preferably within the range of 1.0 to 1.3, more preferably 1.0 to 1.2. If the particle diameter distribution is too great, the resulting toner tends to cause blur or lower transferability, printing density and resolution. The volume average particle diameter and particle diameter distribution of the magenta-colored resin particles can be measured by means of, for example, a Multisizer (manufactured by Beckmann Coulter Co.).

In the magenta-colored resin particles, an average spheroidicity rl/rs obtained by dividing a length rl of each particle by its breadth rs is within the range of preferably 1.0 to 1.3, more preferably 1.0 to 1.2, particularly preferably 1.0 to 1.15. If the average spheroidicity is too great, the transferability of the toner may be lowered in some cases. The average spheroidicity of the magenta-colored resin particles can be easily controlled within the above range by using a phase-inversion emulsification process, dissolution and suspension process, polymerization process or the like.

2. Magenta Toner

The magenta toner according to the present invention may be formed by the magenta-colored resin particles (magenta toner particles) alone. In order to improve cleaning ability, charging ability, flowability and storage stability of the resulting toner, however, the toner is generally prepared by adding an external additive to the magenta-colored resin particles. The magenta toner comprising the magenta-colored resin particles and the external additive is suitable for use as a non-magnetic one-component developer. A two-component developer can be provided by combining the magenta-colored resin particles with carrier particles. An external additive may also be applied to the magenta-colored resin particles used in the two-component developer.

The external additive may be applied to the surfaces of the magenta-colored resin particles by stirring these components in a mixer such as a Henschel mixer, or a part thereof may be embedded therein.

Hexahedral inorganic fine particles are preferably used as the external additive. The hexahedral inorganic fine particles have a form of a hexahedron such as a cube or rectangular parallelopiped. They may be somewhat deformed by, for example, rounding apexes thereof. A length ratio of the longest arris to the shortest arris among arrises making up the hexahedron is preferably within the range of 1 to 2, or is more preferably 1.

No particular limitation is imposed on the chemical structure of the hexahedral inorganic fine particles. However, calcium carbonate is mentioned as a representative thereof. No particular limitation is imposed on the volume average particle diameter of the hexahedral inorganic fine particles. However, it is within the range of preferably 0.05 to 10 μm, more preferably 0.1 to 5 μm. If this volume average particle diameter is too small, the cleaning ability of the resulting toner is lowered. If the volume average particle diameter is too great to the contrary, the flowability of the toner is lowered, and so blur may occur, or image defects may be caused in some cases.

The hexahedral inorganic fine particles are preferably subjected to a hydrophobicity-imparting treatment. As the hexahedral inorganic fine particles subjected to the hydrophobicity-imparting treatment, may be used a commercially available product. However, they may be prepared by subjecting untreated hexahedral inorganic fine particles to a hydrophobicity-imparting treatment with a silane coupling agent, silicone oil, fatty acid, fatty acid metal soap or the like.

No particular limitation is imposed on the amount of the hexahedral inorganic fine particles used. However, it is within the range of preferably 0.05 to 5 parts by mass, more preferably 0.1 to 3 parts by mass per 100 parts by mass of the magenta-colored resin particles. If the amount used is too little, the effect of improving the cleaning ability becomes small. If the amount is too great to the contrary, the flowability of the resulting toner is lowered, and so blur may occur in some cases.

Besides the hexahedral inorganic fine particles, fine particles, whose shape is spherical or indefinable, are preferably used as an external additive. As the fine particles whose shape is spherical or indefinable, any of inorganic fine particles and organic fine particles may be used. However, inorganic fine particles are preferred from the viewpoint of controlling the flowability and charging ability of the resulting toner. These fine particles may be used either singly or in any combination thereof.

Examples of the inorganic fine particles, whose shape is spherical or indefinable, include silica, titanium oxide, aluminum oxide, zinc oxide, tin oxide, barium titanate and strontium titanate. Among these, silica is preferred because fog upon printing can be lessened.

No particular limitation is imposed on the volume average particle diameter of the inorganic fine particles. However, it is within the range of generally 5 to 500 nm, preferably 5 to 100 nm, more preferably 7 to 50 nm. If this volume average particle diameter is too small, the resulting toner undergoes charge-up at a low temperature and a low humidity to lower its printing density. If the volume average particle diameter is too great to the contrary, the flowability of the resulting toner is lowered, and so blur may be liable to occur. The volume average particle diameter of the inorganic fine particles can be measured by, for example, taking an electron microphotograph of the particles, and processing this photograph by means of an image processing analyzer [trade name "LUZEX IID", manufactured by NIRECO Corporation].

These inorganic fine particles preferably have a hydrophobization degree of 30 to 90% as determined by a methanol method.

No particular limitation is imposed on the amount of the inorganic fine particles used as the external additive. However, it is within the range of preferably 0.1 to 5 parts by mass, more preferably 0.3 to 3 parts by mass per 100 parts by mass of the magenta-colored resin particles. If the amount added is too little, the flowability of the resulting toner is lowered, and so blur may occur in some cases. If the amount is too great to the contrary, the flowability becomes too excessive, and so fog may occur in some cases.

No particular limitation is imposed on the spherical or indefinable organic fine particles. From the viewpoint of inhibiting blocking between particles, however, it is desirable that the glass transition temperature or melting point of a compound forming such organic fine particles falls within the range of preferably 80 to 250° C., more preferably 90 to 200° C. Examples of the compound forming the organic fine particles include methyl methacrylate polymers and styrene-methyl methacrylate copolymers.

No particular limitation is imposed on the volume average particle diameter of the organic fine particles. However, it is within the range of preferably 0.1 to 1 μm, more preferably 0.1 to 0.8 μm. No particular limitation is imposed on the spheroidicity rl/rs of the organic fine particles. However, it is within the range of preferably 1.0 to 1.3, more preferably 1.0 to 1.2. If this volume average particle diameter is too small, it may be impossible in some cases to prevent the occurrence of toner filming. If the volume average particle diameter is too great to the contrary, the flowability of the resulting toner may be lowered in some cases. If the spheroidicity is too great, the transferability of the resulting toner may be lowered in some cases.

No particular limitation is imposed on the amount of the organic fine particles added. However, it is within the range of preferably 0.05 to 1 part by mass, more preferably 0.1 to 0.5 part by mass per 100 parts by mass of the magenta-colored resin particles. If the added amount is too little, it is difficult to effectively inhibit a filming phenomenon. If the amount is too great to the contrary, the flowability of the resulting toner becomes poor, and so blur may possibly be liable to occur.

3. Production Process of Magenta-Colored Resin Particles

No particular limitation is imposed on the production process of the magenta-colored resin particles (magenta toner particles) according to the present invention, and they can be produced by, for example, (i) a grinding process, (ii) a polymerization process such as an emulsion polymerization process or suspension polymerization process, or (iii) a dissolution and suspension process.

Among these production processes, the polymerization process is preferred in that magenta-colored resin particles, which can meet the image quality of high resolution and the speeding-up of printing, are easily obtained. Substantially spherical magenta-colored resin particles (i.e., magenta-colored polymer particles) obtained by the suspension polymerization process among the polymerization processes are particularly preferred. The magenta-colored resin particles are made spherical, whereby the magenta-colored resin particles can be prevented from being broken in an image forming apparatus to lower the flowability of the magenta toner.

The production process of the magenta-colored resin particles by the suspension polymerization process will hereinafter be described. Incidentally, colored resin particles obtained by the polymerization process may be called polymerized toner particles or polymerized toner in some cases.

In the suspension polymerization process, a polymerizable monomer composition containing at least a polymerizable monomer and a magenta colorant is prepared, and the resultant polymerizable monomer composition is polymerized in an aqueous dispersion medium to form magenta-colored resin particles (magenta-colored polymer particles). A polymer formed by polymerization of the polymerizable monomer becomes a binder resin. In order to form magenta-colored resin particles having a core-shell structure, a polymerizable monomer for shell is polymerized in the presence of the magenta-colored polymer particles to form a shell layer on each surface of the particles.

In the present invention, a magenta pigment composed of a combination of C.I. Pigment Red 31 and C.I. Pigment Red 150 is used as the magenta colorant. In addition to the magenta colorant, additive components for toner, such as a charge control agent and a parting agent, are contained in the polymerizable monomer composition as needed.

In the polymerization step, the polymerizable monomer composition is suspended in the aqueous dispersion medium containing a dispersion stabilizer to form droplets having a desired droplet diameter. In general, a polymerization initiator is added to the aqueous dispersion medium before the formation of droplets of the polymerizable monomer composition or in the course of the formation thereof to cause the polymerization initiator to migrate into the droplets, and polymerization is initiated by heating the suspension to a prescribed temperature. After completing the polymerization, a remaining unreacted polymerizable monomer is generally distilled off, and the magenta-colored resin particles are then collected by filtration, washing, dehydration and drying.

In the present invention, it is preferred that the magenta pigment be mixed with the charge control resin in advance to prepare a charge control resin composition (which may be referred to as "colorant master batch") from the viewpoint of enhancing the dispersibility of the magenta pigment. In this case, the magenta pigment (total amount of 2 pigments) is mixed in a proportion of preferably 10 to 200 parts by mass, more preferably 20 to 150 parts by mass per 100 parts by mass of the charge control resin.

An organic solvent is preferably used for the preparation of the charge control resin composition containing the magenta pigment and charge control resin. The use of the organic solvent makes the charge control resin soft and easy to mix with the magenta pigment. When no organic solvent is used, it is necessary to heat both component to such a temperature that the charge control resin becomes soft to mix them. When an organic solvent having a low boiling point is used, the organic solvent may be evaporated in some cases by heating. It is thus preferable to mix both components at room temperature or while cooling them. Since a problem of odor may be caused in some cases when the organic solvent remains in the resulting magenta-colored resin particles, the organic solvent is preferably volatilized off or distilled off to remove it in the course of the preparation of the charge control resin composition or the production of the magenta-colored resin particles.

The amount of the organic solvent used is within the range of generally 0 to 100 parts by mass, preferably 5 to 80 parts by mass, more preferably 10 to 60 parts by mass per 100 parts by mass of the charge control resin. When the amount of the organic solvent used falls within this range, a balance between dispersibility and processing ability becomes excellent. The whole amount of the organic solvent may be added either at a time or in several portions while confirming a mixed state.

When the organic solvent is used, it is preferable that the solubility parameter (hereinafter referred to as "SP value") thereof be within the range of 8 to 15 $[cal/cm^3]^{1/2}$, and that the boiling point thereof be within the range of 50 to 150° C. If the SP value of the organic solvent is smaller than 8 $[cal/cm^3]^{1/2}$, its polarity becomes too low, and difficulty is encountered upon dissolution of the charge control resin. If the SP value is greater than 15 $[cal/cm^3]^{1/2}$ to the contrary, the polarity becomes too high, and difficulty is encountered upon dissolution of the charge control resin. On the other hand, if the boiling point of the organic solvent is lower than 50° C., the organic solvent may be evaporated in some cases by heat generated upon the mixing. If the boiling point is higher than 150° C. to the contrary, difficulty is liable to occur upon removal of the organic solvent.

Specific examples of organic solvents (SP value/boiling point) are mentioned together with the SP value and boiling point and include methanol (14.5/65° C.), ethanol (10.0/78.3° C.), propanol (11.9/97.2° C.), diethyl ketone (8.8/102° C.), di-n-propyl ketone (8.0/144° C.), di-isopropyl ketone (8.0/124° C.), methyl n-propyl ketone (8.3/102° C.), methyl isopropyl ketone (8.5/95° C.), methyl n-butyl ketone (8.5/127° C.), methyl isobutyl ketone (8.4/117° C.), toluene (8.9/110° C.), tetrahydrofuran (9.1/65° C.) methyl ethyl ketone (9.3/80° C.), acetone (9.9/56° C.) and cyclohexanone (9.9/156° C.).

These organic solvents may be used either singly or in any combination thereof. Among these, diethyl ketone, methyl n-propyl ketone, methyl n-butyl ketone, methyl ethyl ketone/methanol mixed solvent, toluene/ethanol mixed solvent and toluene/propanol mixed solvent are preferred in view of solubility of the charge control resin and removal efficiency after the mixing.

The mixing of the magenta pigment with the charge control resin may be conducted by means of a mixer such as a roll mill, Plasticoder (manufactured by Brabender Co.), Laboplasto mill (manufactured by Toyo Seiki Co., Ltd.), kneader, single-screw extruder, twin-screw extruder, Banbury mixer or Buss Cokneader. When the organic solvent is used, problems of odor and toxicity arise, and so a mixer capable of mixing in a closed system, in which the organic solvent does not leak, is preferably used. A mixer equipped with a torque meter is preferred because dispersibility can be controlled by the level of torque.

The amount of the charge control resin composition containing the magenta pigment and charge control resin to be used is within the range of preferably 2 to 20 parts by mass, more preferably 3 to 15 parts by mass per 100 parts by mass of the polymerizable monomer. If this amount used is too little, the charge control of the resulting magenta toner is liable to become difficult. If the amount is too great to the contrary, the resulting magenta toner undergoes moisture absorption, and so fog may occur in some cases.

As examples of the polymerizable monomer for forming the binder resin, may be mentioned monovinyl monomers, crosslinkable monomers and macromonomers. The polymerizable monomer is polymerized to provide a binder resin component.

Examples of the monovinyl monomers include aromatic vinyl monomers such as styrene, vinyltoluene and α-methylstyrene; (meth)acrylic acid; derivatives of (meth)acrylic acid, such as methyl(meth)acrylate, ethyl (meth)acrylate, propyl(meth)acrylate, butyl(meth)acrylate, 2-ethylhexyl (meth)acrylate, cyclohexyl(meth)acrylate, isobonyl(meth) acrylate, dimethylaminoethyl(meth)acrylate and (meth) acrylamide; and monoolefin monomers such as ethylene, propylene and butylene.

The monovinyl monomers may be used either singly or in any combination thereof. Among these monovinyl monomers, aromatic vinyl monomers, and combinations of an aromatic vinyl monomer and a derivative of (meth)acrylic acid are preferred.

When a crosslinkable monomer and a crosslinkable polymer are used together with the monovinyl monomer, hot offset of the resulting magenta toner can be effectively improved.

The crosslinkable monomer is a monomer having at least 2 vinyl groups, As specific examples thereof, may be mentioned aromatic divinyl compounds such as divinylbenzene, divinylnaphthalene and derivatives thereof; diethyl-type unsaturated carboxylic acid esters such as ethylene glycol dimethacrylate and diethylene glycol dimethacrylate; compounds having 2 vinyl groups, such as N,N-divinylaniline and divinyl ether; and compounds having three or more vinyl groups, such as pentaerythritol triallyl ether and trimethylolpropane triacrylate.

The crosslinkable polymer is a polymer having two or more vinyl groups in the polymer. As specific examples thereof, may be mentioned esters obtained by subjecting a polymer, such as polyethylene, polypropylene, polyester or polypropylene glycol, having two or more hydroxyl groups in its molecule, and an unsaturated carboxylic acid monomer such as acrylic acid or methacrylic acid to a condensation reaction.

These crosslinkable monomers and crosslinkable polymers may be used either singly or in any combination thereof. The amount of these monomers and polymers used is within the range of generally at most 10 parts by mass, preferably 0.1 to 2 parts by mass per 100 parts by mass of the monovinyl monomer.

It is preferable to use a macromonomer together with the monovinyl monomer because a balance between the storage stability and low-temperature fixing ability of the resulting magenta toner is improved. The macromonomer is an oligomer or polymer having a polymerizable carbon-carbon unsaturated double bond at its molecular chain terminal and a number average molecular weight generally ranging from 1,000 to 30,000. When the number average molecular weight falls within the above-described range, the fixing ability and storage stability of the resulting toner can be retained without impairing the melt properties of the macromonomer. It is hence preferable that the number average molecular weight be within the above range.

Examples of groups having the polymerizable carbon-carbon unsaturated double bond located at its molecular chain terminal include acryloyl and methacryloyl groups. Among these, the methacryloyl group is preferred from the viewpoint of easiness of copolymerization.

The macromonomer is preferably that giving a polymer having a glass transition temperature higher than that of a polymer obtained by polymerizing the monovinyl monomer.

As examples of the macromonomer used in the present invention, may be mentioned polymers obtained by polymerizing styrene, styrene derivatives, methacrylic esters, acrylic esters, acrylonitrile and methacrylonitrile either singly or in combination of two or more monomers thereof, and macromonomers having a polysiloxane skeleton. Among these, hydrophilic macromonomers, in particular, polymers obtained by polymerizing methacrylic esters or acrylic esters either singly or in combination of two or more monomers thereof are preferred.

When the macromonomer is used, the amount of the macromonomer used is within the range of generally 0.01 to 10 parts by mass, preferably 0.03 to 5 parts by mass, more preferably 0.05 to 1 part by weight per 100 parts by weight of the monovinyl monomer. The macromonomer is preferably used in the amount within the above-described range because the storage stability of the resulting magenta toner can be retained without deteriorating the fixing ability thereof.

The suspension polymerization is generally conducted in an aqueous dispersion medium containing a dispersion stabilizer. As examples of the dispersion stabilizers, may be mentioned metallic compounds, such as sulfates such as barium sulfate and calcium sulfate; carbonates such as barium carbonate, calcium carbonate and magnesium carbonate; phosphates such as calcium phosphate; and metal oxides such as aluminum oxide and titanium oxide; and besides, metal hydroxides such as aluminum hydroxide, magnesium hydroxide and ferric hydroxide; water-soluble polymers such as polyvinyl alcohol, methyl cellulose and gelatin; and surfactants such as anionic surfactants, nonionic surfactants and amphoteric surfactants. These dispersion stabilizers may be used either singly or in any combination thereof.

Among these dispersion stabilizers, colloid of a metallic compound, particularly, a hardly water-soluble metal hydroxide is preferred because the particle diameter distribution of the colored polymer particles to be formed can be narrowed, and remaining tendency of the dispersion stabilizer after washing is little, and an image can be brightly or sharply reproduced.

The colloid of the hardly water-soluble metal hydroxide preferably has a particle diameter distribution that a particle diameter $D_{50}$ that the cumulative particle number counting from a smaller particle diameter side is 50% is at most 0.5 μm, and a particle diameter $D_{90}$ that the cumulative particle number is 90% is at most 1 μm. If the particle diameter of the colloid is too great, the stability of the polymerization is broken, and the storage stability of the resulting toner is deteriorated.

The dispersion stabilizer is used in a proportion of generally 0.1 to 20 parts by mass per 100 parts by mass of the polymerizable monomer. The dispersion stabilizer is preferably used in the proportion falling within the above-described range because sufficient polymerization stability is achieved, formation of polymer aggregates is inhibited, and colored polymer particles having a desired particle diameter can be obtained.

As examples of the polymerization initiator, may be mentioned persulfates such as potassium persulfate and ammonium persulfate; azo compounds such as 4,4'-azobis-(4-cyanovaleric acid), 2,2'-azobis(2-methyl-N-(2-hydroxyethyl)propionamide, 2,2'-azobis(2-amidinopropane) dihydrochloride, 2,2'-azobis(2,4-dimethylvaleronitrile) and 2,2'-azobisisobutyronitrile; and peroxides such as di-t-butyl peroxide, dicumyl peroxide, lauroyl peroxide, benzoyl peroxide, t-butyl peroxy-2-ethylhexanoate, t-hexyl peroxy-2-ethylhexanoate, t-butyl peroxypivalate, di-isopropyl peroxydicarbonate, di-t-butyl peroxyisophthalate, 1,1,3,3-tetramethylbutyl peroxy-2-ethylhexanoate and t-butyl peroxyisobutyrate. Redox initiators composed of combinations of these polymerization initiators with a reducing agent may also be used.

It is preferable to select an oil-soluble polymerization initiator soluble in the used polymerizable monomer from among these. A water-soluble polymerization initiator may also be used in combination with the above-described initiator as needed. The polymerization initiator is used in a proportion of generally 0.1 to 20 parts by mass, preferably 0.3 to 15 parts by mass, more preferably 0.5 to 10 parts by mass per 100 parts by weight of the polymerizable monomer.

The polymerization initiator may be added into the polymerizable monomer composition in advance. In order to prevent premature polymerization in, for example, the step of preparing the polymerizable monomer composition or the step of forming the droplets, however, the polymerization initiator may be directly added into a suspension in the course of the formation of droplets of the polymerizable monomer composition or after completion of the formation of the droplets in the case of suspension polymerization, or an emulsion after completion of a emulsifying step in the case of emulsion polymerization.

Upon the polymerization, a molecular weight modifier is preferably used. As examples of the molecular weight modifier, may be mentioned mercaptans such as t-dodecylmercaptan, n-dodecylmercaptan, n-octylmercaptan and 2,2,4,6,6-pentamethylheptane-4-thiol; and halogenated hydrocarbons such as carbon tetrachloride and carbon tetrabromide. These molecular weight modifiers may be added before the initiation of the polymerization or in the course of the polymerization. The molecular weight modifier is used in a proportion of generally 0.01 to 10 parts by mass, preferably 0.1 to 5 parts by mass per 100 parts by weight of the polymerizable monomer.

Examples of a process for producing the magenta-colored resin particles having the core-shell structure include processes such as a spray drying process, interfacial reaction process, in-situ polymerization process and phase separation process. More specifically, magenta-colored resin particles obtained by a grinding process, polymerization process, association process, phase-inversion emulsification process or the like are used as core particles, a shell layer is formed on the surface of each of the core particles, whereby the magenta-colored resin particles having the core-shell structure can be obtained. Among these production processes, in-situ polymerization process and phase-inversion emulsification process are preferred from the viewpoint of production efficiency.

The production process of the magenta-colored resin particles having the core-shell structure by the in-situ polymerization process will hereinafter be described.

A polymerizable monomer (polymerizable monomer for shell) for forming shell layers and a polymerization initiator are added into an aqueous dispersion medium with core particles dispersed therein and polymerized to form a shell layer composed of a polymer on the surface of each of the core particles, whereby magenta-colored resin particles of the core-shell structure can be obtained.

As specific processes for forming the shell layers, may be mentioned a process, in which a polymerizable monomer for shell is added into a reaction system of a polymerization reaction conducted for obtaining core particles, and the polymerization reaction is continued; a step-wise process, in which core particles obtained in a separate reaction system are charged into an aqueous dispersion medium, and a polymerizable monomer for shell is added to the resultant dispersion to conduct polymerization, and the like.

The polymerizable monomer for shell may be added into the reaction system at a time, or may be added continuously or intermittently by means of a pump such as a plunger pump.

As the polymerizable monomer for shell, monomers respectively forming polymers having a glass transition temperature exceeding 80° C., such as styrene, acrylonitrile and methyl methacrylate, are preferably used either singly or in combination of two or more monomers thereof.

A water-soluble polymerization initiator is preferably added upon the addition of the polymerizable monomer for shell because the magenta-colored resin particles of the core-shell structure are easy to be obtained. It is considered that when the water-soluble polymerization initiator is added upon the addition of the polymerizable monomer for shell, the water-soluble polymerization initiator enters in the vicinity of each surface of the core particles to which the polymerizable monomer for shell has migrated, and consequently a polymer (shell) layer is easy to be formed on each surface of the core particles.

As examples of the water-soluble polymerization initiator, may be mentioned persulfates such as potassium persulfate and ammonium persulfate; and azo type initiators such as 2,2'-azobis[2-methyl-N-(2-hydroxyethyl)-propionamide] and 2,2'-azobis-[2-methyl-N-[1,1-bis(hydroxymethyl)ethyl] propionamide. The amount of the water-soluble polymerization initiator used is within the range of generally 0.1 to 50 parts by mass, preferably 1 to 30 parts by mass per 100 parts by mass of the polymerizable monomer for shell.

4. Production Process of Magenta Toner

A magenta toner can be produced as a non-magnetic one-component developer by adding an external additive to magenta-colored resin particles (magenta toner particles). A magenta toner can be produced as a two-component developer by mixing magenta-colored resin particles with carrier particles. A process, in which magenta-colored resin particles (including magenta-colored resin particles of the core-shell structure) are synthesized by the suspension polymerization process, and an external additive is added to the magenta-colored resin particles to produce a non-magnetic one-component developer (magenta toner), is preferred.

EXAMPLES

The present invention will hereinafter be described more specifically by the following examples and comparative examples. However, the present invention is not limited to these examples alone. All designations of "part" or "parts" and "%" mean part or parts by mass and % by mass unless expressly noted.

Various physical properties and characteristics in the present invention were evaluated in accordance with the following respective methods.

1. Physical Properties of Toner (1) Average Particle Diameter and Particle Diameter Distribution of Toner Particles:

The volume average particle diameter dv and particle diameter distribution, i.e., a ratio dv/dp of the volume average particle diameter to the number average particle diameter dp, of toner particles (colored polymer particles) were measured by means of a Multisizer (manufactured by Beckmann Coulter Co.). The measurement by this Multisizer was conducted under the following conditions:

aperture diameter: 100 μm;

medium: Isothone II, concentration: 10%; and the number of particles measured: 100,000 particles.

(2) Spheroidicity:

A photograph of toner particles was taken by a scanning electron microscope, and the photograph was read in an image processor, into which a Nexus 9000 type software had been incorporated, to determine a value rl/rs by dividing a length rl of each toner particle by a breadth rs thereof. The number of particles measured was 100 particles, and an average value of the measured values was regarded as an average spheroidicity.

2. Evaluation of Toner Properties (1) Charge Level:

A charge level of a developer (toner) comprising toner particles was measured under respective environments of L/L environment of 10° C. in temperature and 20% in humidity, N/N environment of 23° C. in temperature and 50% in humidity, and H/H environment of 35° C. in temperature and 80% in humidity.

More specifically, a printer on the market (manufactured by Oki Data Corporation, trade name "MICROLINE 3010C") of the non-magnetic one-component development system was charged with a toner sample and left to stand for a day under the respective environments described above, and a half-tone print pattern was then printed by 5 sheets. Thereafter, the toner on a development roller was sucked by a suction type charge level meter to measure a charge level per unit mass from a charge level of the toner sucked and an amount of the toner sucked.

(2) Storage Stability:

About 20 g of a toner sample were precisely weighed and placed in a closed bottle. The weight of the toner at this time was regarded as W1. The bottle was sunk into a constant-temperature water bath controlled to 55° C. The bottle was taken out of the water bath after 8 hours had elapsed, and the toner contained in the bottle was transferred to a 42-mesh sieve so as not to destroy the structure of the toner as much as possible. The sieve was vibrated for 30 seconds by means of a powder-measuring device ("Powder Tester", trade name; manufactured by Hosokawa Micron Corporation) with vibration intensity preset to 4.5. The weight of the toner remaining on the sieve was then measured to regard it as the weight of the toner aggregated. A percentage (% by weight) of the weight W2 of the aggregated toner to the weight W1 of the toner sample was calculated out in accordance with an equation [(W2/W1)×100]. The value was used as an index to the storage stability of the toner sample. The smaller the value, the higher the storage stability.

(3) Evaluation of Image Quality:

i) Color Tone:

After paper for printing was set in the above-described printer, a toner sample was charged into a developing device, and the printer was left to stand for a day under (N/N) environment of 23° C. in temperature and 50% in humidity, solid printing was conducted. With respect to the paper, on which the solid printing had been conducted, the L*a*b* color space thereof was measured by means of a spectroscopic color-difference meter (manufactured by Nippon Denshoku K. K., model name "SE2000"). With respect to a hue difference from the magenta of Japan Color, a color tone of Japan Color Standard Paper measured likewise and a color tone obtained by printing with the toner sample are represented as coordinates of the L*C*H* color space to calculate out the hue difference ΔH in accordance with the following equation:

$$\Delta H^* = [(\Delta E^*)^2 - (\Delta L^*)^2 - (\Delta C^*)^2]^{1/2}$$

wherein

ΔE*: a color difference by the L*a*b* color space,

ΔL*: a lightness index difference between 2 object colors in the L*a*b* color space, and ΔC*: a difference between 2 object colors, ab chromas in the L*a*b* color space.

The amount of the toner attached to the surface of the paper in the solid printing was controlled so as to be about 0.45 mg/cm$^2$.

ii) Printing Density:

After paper for printing was set in the above-described printer, a toner sample was charged into a developing device, and the printer was left to stand for a day under H/H environment of 35° C. in temperature and 80% in humidity, printing was continuously conducted from the beginning at a density of 5%, and solid printing was conducted upon printing on the 20,000-th paper sheet. With respect to the solid-printed paper sheet, the printing density was measured by means of a color reflection densitometer (manufactured by X-Light Co., model name "404A").

iii) Fog:

After paper for printing was set in the above-described printer, a toner sample was charged into a developing device, and the printer was left to stand for a day under each environment of L/L environment of 10° C. in temperature and 20% in humidity, N/N environment of 23° C. in temperature and 50% in humidity and H/H environment of 35° C. in temperature and 80% in humidity, printing was continuously conducted at a density of 5%. After conducting printing on 20,000 sheets of paper, blank printing of a sheet of paper was conducted, the blank printing was stopped on the way, and a toner in an unprinted area on a photosensitive member after development was taken out using a pressure-sensitive adhesive tape (product of Sumitomo 3M Limited, trade name "Scotch Mending Tape 810-3-18"). This adhesive tape was applied to new paper for printing. The color tone B of the paper for printing, to which this adhesive tape had been applied, was measured by the spectroscopic color-difference meter, and the color tone A of paper for printing, to which only a pressure-sensitive adhesive tape had been applied, was measures likewise. Their color tones were represented as coordinates of the L*a*b* color space to calculate out a color difference ΔE to regard it as a fog value. The smaller the value, the less the fog.

(4) Fixing Temperature:

The above-described printer was modified in such a manner that the temperature of a fixing roll can be varied. This modified printer was used to vary the temperature of the fixing roll at intervals of 5° C., thereby determining a fixing rate of a toner sample at each temperature.

In order to stabilize the temperature of the fixing roll varied, the modified printer was left to stand for at least 5 minutes at each temperature set, and solid printing was then conducted on paper for printing by the modified printer. With respect to the solid-printed area of the paper printed, the fixing rate was calculated from a ratio of printing densities before and after a peeling operation using a tape. More specifically, assuming that the image density before the peeling of the tape is $ID_{before}$, and the image density after the peeling of the tape is $ID_{after}$, the fixing rate is calculated out in accordance with the following equation:

$$\text{Fixing rate (\%)}=(ID_{after}/ID_{before})\times 100$$

The peeling operation of the tape is a series of operation that a pressure-sensitive adhesive tape (product of Sumitomo 3M Limited, trade name "Scotch Mending Tape 810-3-18") is applied to a measuring area of paper for test to cause the tape to adhere to the paper by pressing the tape under a fixed pressure, and the adhesive tape is then peeled at a constant rate in a direction along the paper.

In this fixing test, a temperature of the fixing roll, at which a fixing rate of the toner amounted to 80%, was defined as a fixing temperature of the toner.

(5) Hot Offset Temperature:

The temperature of the fixing roll was varied in the same manner as in the measurement of the fixing temperature to conduct solid printing, thereby measuring a temperature, at which hot offset occurred. The temperature of the fixing roll, at which hot offset occurred, was defined as a hot offset temperature of the toner.

Example 1

1. Preparation of Charge Control Resin Composition (Pigment Master Batch):

In 100 parts of a charge control resin (weight average molecular weight: 18,000; glass transition temperature: 67° C.) obtained by polymerizing a monomer mixture composed of 82% of styrene, 11% of n-butyl acrylate and 7% of 2-acrylamido-2-methylpropanesulfonic acid, were dispersed 24 parts of methyl ethyl ketone and 6 parts of methanol, and the dispersion was kneaded by rolls while cooling it. At the time the charge control resin wound around the rolls, 55 parts of C.I. Pigment Red 31 and 45 parts of C.I. Pigment Red 150 were gradually added as a magenta pigment, and the resultant mixture was kneaded for 1 hour to prepare a charge control resin composition containing the magenta pigment. At this time, a nip between the rolls was preset to 1 mm at the beginning of the kneading, gradually widened after this and finally widened to 3 mm. An organic solvent (4/1 mixed solvent of methyl ethyl ketone/methanol) was additionally added several times according to the kneaded state of the charge control resin.

A part of the charge control resin composition was taken out, and toluene was added to this part to dissolve it, thereby preparing a 5% toluene solution of the charge control resin composition. A doctor blade at an interval of 30 μm was used to apply the 5% toluene solution on to a glass plate and dried to form a sheet of the charge control resin composition. This sheet was observed through a optical microscope of 400 magnifications. As a result, no magenta pigment particle having a length of 0.2 μm or greater was present in a visual field 100 μm square.

2. Preparation of Aqueous Dispersion Medium Containing Dispersion Stabilizer:

An aqueous solution with 6.9 parts of sodium hydroxide (alkali metal hydroxide) dissolved in 50 parts of ion-exchanged water was gradually added to an aqueous solution with 9.8 parts of magnesium chloride (water-soluble polyvalent metal salt) dissolved in 250 parts of ion-exchanged water under stirring to prepare a dispersion of magnesium hydroxide colloid (colloid of hardly water-soluble metal hydroxide). The particle diameter distribution of the colloid prepared was measured. As a result, the particle diameter was 0.38 μm in terms of $D_{50}$ (50% cumulative value of number particle diameter distribution) and 0.82 μm in terms of $D_{90}$ (90% cumulative value of number particle diameter distribution).

3. Preparation of Polymerizable Monomer Composition for Core:

A polymerizable monomer for core composed of 80.5 parts of styrene, 19.5 parts of n-butyl acrylate, 0.5 parts of divinylbenzene and 0.25 parts of a polymethacrylic ester macromonomer (product of Toagosei Chemical Industry Co., Ltd., trade name "AA6") were mixed under stirring with 12 parts of the above-described charge control resin composition, 2 parts of t-dodecylmercaptan and 10 parts of dipentaerythritol hexamyristate into a uniform dispersion, thereby obtaining a polymerizable monomer composition for core.

4. Preparation of Polymerizable Monomer for Shell:

One part of methyl methacrylate and 100 parts of water were subjected to a finely dispersing treatment by an ultrasonic emulsifier to obtain an aqueous dispersion of a polymerizable monomer for shell. The diameter of droplets of the polymerizable monomer for shell was measured by means of (SALD2000A Model, manufactured by Shimadzu Corporation) and found to be 1.6 μm in terms of $D_{90}$.

5. Step of Forming Droplets:

After the polymerizable monomer composition for core obtained in the preparation step 3 was poured into the colloidal dispersion of magnesium hydroxide obtained in the preparation step 2, and the mixture was stirred until droplets became stable, 6 parts of t-butyl peroxy-2-ethylhexanoate (product of Nippon Oil & Fats Co., Ltd., trade name "Perbutyl O") were added. Thereafter, the resultant dispersion was stirred 30 minutes at 15,000 rpm under high shearing force by means of a dispersing machine (manufactured by Ebara Corporation, trade name "Ebara Milder") to form finer droplets of the polymerizable monomer composition.

6. Polymerization Step:

A reactor equipped with an agitating blade was charged with the aqueous dispersion of the polymerizable monomer composition for core obtained in the step 5 to initiate a polymerization reaction at 90° C. At the time a conversion into a polymer reached almost 100%, the reaction mixture was sampled to measure a volume average particle diameter of colored polymer particles (core particles). As a result, it was 7.4 μm.

The aqueous dispersion of the polymerizable monomer for shell obtained in the step 4 and 0.2 parts of 2,2'-azobis [2-methyl-N-(2-hydroxyethyl)propionamide] (product of Wako Pure Chemical Industries, Ltd., trade name "VA-086") dissolved in 65 parts of distilled water were charged into the reactor, and the polymerization was then continued for 8 hours. After the temperature of the aqueous dispersion was lowered to 80° C. while retaining agitation, and nitrogen gas was introduced while retaining this temperature to distil off unreacted polymerizable monomers, the residue was cooled to obtain an aqueous dispersion of magenta toner particles at pH 9.5.

7. Washing and Collecting Step:

The pH of the system was adjusted to 5 or lower with sulfuric acid while stirring the aqueous dispersion of the magenta toner particles obtained in the step 6 to conduct acid washing (25° C., 10 minutes). After water was then separated by filtration, 500 parts of ion-exchanged water were newly added to form a slurry again, and the slurry was washed with water. Thereafter, the dehydration and water washing were repeated several times, and solids were then separated by filtration. The solids were dried at 45° C. for 2 days by a dryer to obtain dry magenta toner particles.

The volume average particle diameter dv of the dry magenta toner particles was 7.4 μm, a particle diameter distribution dv/dp was 1.23, and an average spheroidicity rl/rs was 1.1. The magenta toner particles are colored polymer particles having a core-shell structure.

7. Preparation of Non-Magnetic One-Component Developer:

Into 100 parts of the magenta toner particles obtained above were mixed 0.3 parts of cubical calcium carbonate (product of Maruo Calcium Co., Ltd., trade name "CUBE-03BHS") having a volume average particle diameter of 0.3 μm, 0.5 parts of indefinable finely particulate silica (product of Nippon Aerosil Co., Ltd., trade name "RX-300") subjected to a hydrophobicity-imparting treatment and 2.0 parts of indefinable finely particulate silica (product of Nippon Aerosil Co., Ltd., trade name "RX-50") subjected to a hydrophobicity-imparting treatment, by means of a Henschel mixer to prepare a magenta toner (non-magnetic one-component developer).

The properties of the toner thus obtained and the results of the evaluation as to image quality are shown in Table 1.

Comparative Example 1

1. Preparation of Aqueous Dispersion Medium Containing Dispersion Stabilizer:

A 2-liter 4-necked flask equipped with a high-speed agitating machine, TK type homomixer (manufactured by Tokushu Kika Kogyo Co., Ltd.) was charged with 360 parts of ion-exchanged water and 430 parts of a 0.1 mol/liter aqueous solution of $Na_3PO_4$. The rotating speed of the high-speed agitating machine was preset to 12,000 rpm, and the system was heated to 65° C. while stirring the aqueous solution. To this aqueous solution, were added 34 parts of a 1.0 mol/liter aqueous solution of $CaCl_2$ to prepare an aqueous dispersion with a hardly water-soluble dispersion stabilizer $Ca_3(PO_4)_2$ finely dispersed therein.

2. Preparation of Pigment-Dispersed Composition:

A mixture composed of 43 parts of styrene, 4.5 parts of C.I. Pigment Red 122 (content of calcium abietate: 0.5 parts) treated with calcium abietate, 2.3 parts of C.I. Pigment Red 150 (content of calcium abietate: 0.3 parts) treated with calcium abietate, 3 parts of a charge control agent (product of Orient Chemical Industries Ltd., trade name "E-89") and 6 parts of a polyester resin (peak molecular weight=5,000, acid value=20 mg KOH/g) was dispersed for 3 hours by means of an Attritor (manufactured by Mitsui Kinzoku Kogyo Co., Ltd.) to prepare a pigment-dispersed composition.

3. Preparation of Polymerizable Monomer Composition:

A container was charged with 40 parts of styrene, 17 parts of n-butyl acrylate, 0.2 parts of divinylbenzene, 15 parts of a wax component (higher alcohol wax, melting point=70° C.) and the whole amount (58.8 parts) of the pigment-dispersed composition obtained in the preparation step 2, the contents were dispersed and dissolved while being heated to 70° C., and 3 parts of 2,2'-azobis(2,4-dimethyl-valeronitrile) were added to prepare a polymerizable monomer composition.

4. Step of Forming Droplets:

The polymerizable monomer composition obtained in the preparation step 3 was poured into the aqueous dispersion medium obtained in the preparation step 1, and the resultant mixture was stirred for 5 minutes while retaining the rotating speed of a high-speed agitating machine at 15,000 rpm under a nitrogen gas atmosphere at an internal temperature of 65° C. to form droplets of the polymerizable monomer composition.

5. Polymerization Step:

After the step of forming the droplets, the agitating machine was changed to that equipped with a paddle-agitating blade to conduct polymerization with the temperature kept at the same temperature while stirring at 200 rpm, and the polymerization reaction was completed at the time a conversion of the polymerizable monomer into a polymer reached almost 100%.

6. Washing and Collecting Step:

After completion of the polymerization, unreacted polymerizable monomers were distilled off heating under reduced pressure. After cooling, dilute hydrochloric acid was added to the reaction mixture to dissolve the hardly water-soluble dispersing agent. After washing with water was conducted several times repeatedly, a drying treatment was conducted to obtain magenta toner particles.

7. Preparation of Non-Magnetic One-Component Developer:

Into 100 parts of the magenta toner particles obtained above were mixed 1.5 parts of indefinable finely particulate silica (product of Nippon Aerosil Co., Ltd., trade name "R-202") subjected to a hydrophobicity-imparting treatment, by means of a Henschel mixer to prepare a magenta toner (non-magnetic one-component developer).

The properties of the magenta toner thus obtained and the results of the evaluation as to image quality are shown in Table 1.

Comparative Example 2

1. Preparation of Aqueous Dispersion Medium Containing Dispersion Stabilizer:

A 2-liter 4-necked flask equipped with a high-speed agitating machine, TK type homomixer (manufactured by Tokushu Kika Kogyo Co., Ltd.) was charged with 360 parts of ion-exchanged water and 430 parts of a 0.1 mol/liter aqueous solution of $Na_3PO_4$. The rotating speed of the high-speed agitating machine was preset to 12,000 rpm, and the system was heated to 65° C. To this aqueous solution, were added 34 parts of a 1.0 mol/liter aqueous solution of $CaCl_2$ to prepare an aqueous dispersion with a hardly water-soluble dispersion stabilizer $Ca_3(PO_4)_2$ finely dispersed therein.

2. Preparation of Polymerizable Monomer Composition:

After a mixture composed of 83 parts of styrene, 17 parts of n-butyl acrylate, 6.6 parts of C.I. Pigment Red 150 (content of calcium abietate: 0.6 parts) treated with calcium abietate, 5 parts of a polyester resin (Mw=25,000), 0.03 parts of d-t-butylsalicylic acid and 15 parts of an ester wax (Mn=1,000, Mw/Mn=1.9) was dispersed for 3 hours by means of a dispersing machine (manufactured by Mitsui Kinzoku Kogyo Co., Ltd., trade name "Attritor"), 3 parts of 2,2'-azobis(2,4-dimethylvaleronitrile) were added to prepare a polymerizable monomer composition.

3. Step of Forming Droplets:

The polymerizable monomer composition obtained in the preparation step 2 was poured into the aqueous dispersion medium obtained in the preparation step 1, and the resultant mixture was stirred for 5 minutes while retaining the rotating speed of a high-speed agitating machine at 15,000 rpm under a nitrogen gas atmosphere at an internal temperature of 60° C. to form droplets of the polymerizable monomer composition.

4. Polymerization Step:

Thereafter, the agitating machine was changed to that equipped with a paddle-agitating blade to conduct polymerization for 5 hours with the temperature kept at the same temperature while stirring at 200 rpm.

5. Washing and Collecting Step:

After completion of the polymerization, sodium hydrogencarbonate was added into the aqueous dispersion medium to adjust the pH to 11 again, 1 part of potassium persulfate that is a water-soluble initiator was additionally added to conduct distillation for 5 hours under a reduced pressure of 350 mmHg at an internal temperature of 80° C. After cooling, dilute hydrochloric acid was added to adjust the pH of the aqueous dispersion medium to 1.2, thereby dissolving the hardly water-soluble dispersing agent. After filtration and washing with water were conducted several times repeatedly, and solid-liquid separation was performed, the resultant solids were subjected to a drying treatment to obtain magenta toner particles.

6. Preparation of Non-Magnetic One-Component Developer:

Into 100 parts of the magenta toner particles obtained above were added 0.7 parts of titanium oxide subjected to a hydrophobicity-imparting treatment and having an average particle diameter of 30 nm and 0.7 parts of finely particulate silica (product of Nippon Aerosil Co., Ltd., trade name "R-202") subjected to a hydrophobicity-imparting treatment, and these components were mixed by means of a Henschel mixer to prepare a magenta toner (non-magnetic one-component developer).

The properties of the magenta toner thus obtained and the results of the evaluation as to image quality are shown in Table 1.

Comparative Example 3

1. Preparation of Ground Toner:

After 100 parts of a polyester resin (condensation polymer of propoxylated bisphenol A and fumaric acid, acid value: 10.8 mg KOH/g), 4 parts of a charge control agent (aluminum compound of di-t-butylsalicylic acid) having negatively charging ability and 5 parts of C.I. Pigment Red 31 were sufficiently premixed by means of a Henschel mixer, the resultant mixture was melt-kneaded by a twin-screw extruder. After cooling the kneaded product, it was coarsely ground to the size of about 1 to 2 mm by means of a hammer mill, and the resultant coarse particles were finely ground by an air-jet type mill. Finely ground powder and coarsely ground powder were simultaneously precisely removed from the finely ground product by a multi-division classifier, thereby obtaining magenta toner particles having an average particle diameter of 8.0 μm.

2. Preparation of Non-Magnetic One-Component Developer:

Into 100 parts of the magenta toner particles obtained above were mixed 1.5 parts of finely particulate silica (product of Nippon Aerosil Co., Ltd., trade name "R-202") subjected to a hydrophobicity-imparting treatment by means of a Henschel mixer to prepare a magenta toner (non-magnetic one-component developer).

The properties of the magenta toner thus obtained and the results of the evaluation as to image quality are shown in Table 1.

TABLE 1

| | Japan Color | Ex. | Comp. Ex. | | |
|---|---|---|---|---|---|
| | Magenta | 1 | 1 | 2 | 3 |
| Magenta pigment | | PR31 PR150 | PR122 PR150 | PR150 | PR31 |
| Physical properties of toner particles | | | | | |
| Volume average diameter (μm) particle | | 7.2 | 8.2 | 7.8 | 8.0 |
| Particle diameter distribution | | 1.23 | 1.39 | 1.42 | 1.47 |
| Average spheroidicity | | 1.13 | 1.20 | 1.22 | 1.53 |
| Properties of toner | | | | | |
| Charge level (μC/g) | | | | | |
| L/L environment | | −42 | −60 | −30 | −35 |
| N/N environment | | −32 | −55 | −25 | −25 |
| H/H environment | | −35 | −18 | −14 | −20 |
| Storage stability (%) | | 2.0 | 3.5 | 4.5 | 50 |
| Evaluation of image quality | | | | | |
| Hue | | | | | |
| L* | 44.26 | 43.92 | 51.17 | 49.20 | 48.72 |
| a* | 69.06 | 66.49 | 64.56 | 59.83 | 57.43 |
| b* | −9.37 | −5.65 | −16.49 | 4.21 | −1.73 |

TABLE 1-continued

| | Japan Color Magenta | Ex. 1 | Comp. Ex. 1 | Comp. Ex. 2 | Comp. Ex. 3 |
|---|---|---|---|---|---|
| Hue difference (ΔH) | | 3.24 | 7.85 | 13.23 | 6.62 |
| Amount attached on to paper (mg/cm$^2$) | | 0.45 | 0.45 | 0.46 | 0.44 |
| Printing density | | 1.49 | 1.34 | 1.39 | 1.31 |
| Fog | | | | | |
| L/L environment | | 0.3 | 1.5 | 0.7 | 0.4 |
| N/N environment | | 0.1 | 1.1 | 1.5 | 1.2 |
| H/H environment | | 0.7 | 2.4 | 6.2 | 1.1 |
| Fixing temperature (° C.) | | 140 | 170 | 170 | 140 |
| Hot offset temperature (° C.) | | 200 | 200 | 200 | 150 |

(Note)
PR31: C.I. Pigment Red 31
PR122: C.I. Pigment Red 122
PR150: C.I. Pigment Red 150

From the results shown in Table 1, the following facts are known.

It is known that the magenta toner of Comparative Example 1 making use of the mixture of C.I. Pigment Red 122 and C.I. Pigment Red 150 as a magenta pigment is much removed in hue from the magenta of the Japan Color standard paper printed by inks, low in printing density, liable to cause fog under the respective environments and also poor in low-temperature fixing ability.

It is known that the magenta toner of Comparative Example 2 making use of C.I. Pigment Red 150 alone as a magenta pigment is much removed in hue from the magenta of the Japan Color standard paper printed by inks, low in printing density, liable to cause fog under both N/N environment and H/H environment and also poor in low-temperature fixing ability.

It is known that the magenta toner of Comparative Example 3 making use of C.I. Pigment Red 31 alone as a magenta pigment is much removed in hue from the magenta of the Japan Color standard paper printed by inks, low in printing density, liable to cause fog under both N/N environment and H/H environment, easy to cause hot offset and also poor in storage stability of the toner.

On the other hand, the magenta toner of Example 1 according to the present invention can form an image of a hue near to the magenta of the Japan Color standard paper printed by inks by using, as the magenta pigment, C.I. Pigment Red 31 and C.I. Pigment Red 150 in combination, and is high in printing density, hard to cause fog, excellent in low-temperature fixing ability and hard to cause hot offset even after conducting printing of 20,000 sheets as a durability test or even under any environment.

INDUSTRIAL APPLICABILITY

According to the present invention, there can be provided magenta toners which are high in printing density, causes no fog and can reproduce a magenta hue equivalent to printing with inks, and a production process thereof. The magenta toners according to the present invention can fix at a low temperature, and are hard to cause fog even under severe environments of low temperature and low humidity, and high temperature and high humidity. Further, the magenta toners according to the present invention prevent their magenta toner particles from breaking in an image forming apparatus to low flowability, prevents images obtained by printing from fading and have little possibility of causing an environmental problem even when transfer media, on which images have been formed with the toners, are incinerated.

The invention claimed is:

1. A magenta toner having magenta-colored resin particles comprising at least a binder resin and a magenta colorant, wherein the magenta colorant is a magenta pigment composed of the combination of C.I. Pigment Red 31 and C.I. Pigment Red 150 within the range from 40:60 to 70:30 in terms of a mass ratio, and the magenta-colored resin particles have a volume average particle diameter dv within the range from 3.0 to 12.0 μm.

2. The magenta toner according to claim 1, wherein the magenta-colored resin particles contains the magenta pigment composed of the combination of C.I. Pigment Red 31 and C.I. Pigment Red 150 in the proportion of 1 to 10 parts by mass per 100 parts by mass of the binder resin.

3. The magenta toner according to claim 1, wherein the magenta-colored resin particles further comprises a charge control resin as a charge control agent.

4. The magenta toner according to claim 3, wherein the charge control resin has a weight average molecular weight within the range from 2,000 to 50,000 and a glass transition temperature within the range from 40 to 80° C.

5. The magenta toner according to claim 1, wherein the magenta-colored resin particles further comprises a parting agent.

6. The magenta toner according to claim 1, wherein the magenta-colored resin particles are magenta-colored resin particles having a core-shell structure.

7. The magenta toner according to claim 1, wherein the magenta-colored resin particles have a particle diameter distribution dv/dp within the range from 1.0 to 1.3 in terms of the ratio of the volume average particle diameter dv to the number average particle diameter dp.

8. The magenta toner according to claim 1, wherein the spheroidicity rl/rs represented by the ratio of the length rl of each magenta-colored resin particle to the breadth rs thereof is within the range from 1.0 to 1.3.

9. The magenta toner according to claim 1, which comprises the magenta-colored resin particles and an external additive.

10. The magenta toner according to claim 9, wherein the external additive is composed of hexahedral inorganic fine particles having the volume average particle diameter of 0.05 to 10 μm.

11. The magenta toner according to claim 9, wherein the external additive is composed of spherical or indefinable inorganic fine particles having the volume average particle diameter from 5 to 500 nm.

12. The magenta toner according to claim 9, wherein the external additive is composed of organic fine particles having the volume average particle diameter from 0.1 to 1 μm.

13. A process for producing a magenta toner having magenta-colored resin particles, which comprises:

Step 1 of preparing a polymerizable monomer composition containing at least a polymerizable monomer and a magenta colorant; and Step 2 of polymerizing the polymerizable monomer composition in an aqueous dispersion medium to form the magenta-colored resin particles;

wherein a magenta pigment composed of a combination of C.I. Pigment Red 31 and C.I. Pigment Red 150 within the range from 40:60 to 70:30 in terms of a mass ratio is used as the magenta colorant, and whereby obtaining magenta-colored resin particles having a volume average particle diameter dv within the range from 3.0 to 12.0 μm.

14. The production process according to claim 13, wherein, in the Step 1, the polymerizable monomer composition further contains a charge control agent.

15. The production process according to claim 14, wherein, in the Step 1:

a charge control resin is used as the charge control agent;

a charge control resin composition containing the magenta pigment and the charge control resin is prepared in advance; and the charge control resin composition is contained in the polymerizable monomer composition.

16. The production process according to claim 15, wherein the magenta pigment and the charge control resin are mixed in the presence of an organic solvent to prepare the charge control resin composition.

17. The production process according to claim 13, wherein, in the Step 1, the polymerizable monomer further comprises a parting agent.

18. The production process according to claim 13, wherein, in the Step 2, a polymerizable monomer for shell is further polymerized in the presence of the magenta-colored resin particles formed, to form magenta-colored resin particles with a core-shell structure.

19. The production process according to claim 13, which further comprises the step of adding an external additive to the magenta-colored resin particles obtained in Step 2.

* * * * *